US005806968A

United States Patent [19]

Tsai

[11] Patent Number: 5,806,968

[45] Date of Patent: Sep. 15, 1998

[54] LAMP COMBINATION

[76] Inventor: Tien-Tzu Tsai, No. 17-1,1 Section, Ta Ching Street, Southern Dis., Taichung, Taiwan

[21] Appl. No.: 857,145

[22] Filed: May 15, 1997

[51] Int. Cl.[6] ..... F21V 33/00

[52] U.S. Cl. ..... 362/225; 362/101; 362/223; 362/418

[58] Field of Search ..... 362/101, 223, 362/217, 225, 285, 418, 396, 375, 374, 253

[56] References Cited

U.S. PATENT DOCUMENTS 3,834,351 9/1974 Schmidt ..... 362/101
4,613,930 9/1986 Ambasz ..... 362/223

*Primary Examiner*—Thomas M. Sember
*Attorney, Agent, or Firm*—Charles F. Baxley, Esq.

[57] ABSTRACT

A lamp combination includes a body member, a cover secured on top of the body member, two lamp shades secured to the side portions of the body member, one or more lamps secured to the bottom of the body member, and a plate secured to the lower portions of the lamp shades and the caps. The side portions of the body member each includes an upper and a lower engaging members. The lamp shades each includes an upper and a lower engaging members for engaging with the engaging members of the body member and for allowing the lamp shades to be easily secured to the body member. A pair of supports may be secured to the lower portions of the caps and of the lamp shades for supporting the lamp combination.

3 Claims, 5 Drawing Sheets

LAMP COMBINATION

BACKGROUND OF THE INVENTION

1. Field of the Invention

The present invention relates to a lamp, and more particularly to a lamp combination for an aquarium.

2. Description of the Prior Art

Typical lamps for an aquarium are directly secured to the adaptors and are exposed. No lamp shades are provided for shading the lamps that are disposed in the aquarium. In addition, the height of the typical lamp that is disposed in the aquarium may not be adjusted.

The present invention has arisen to mitigate and/or obviate the afore-described disadvantages of the conventional lamps for an aquarium.

SUMMARY OF THE INVENTION

The primary objective of the present invention is to provide a lamp combination which includes a lamp shade having a number of members that may be easily assembled.

The other objective of the present invention is to provide a lamp combination in which the height of the lamp may be adjusted by leg members.

In accordance with one aspect of the invention, there is provided a lamp combination comprising a body including two side portions and including an upper portion and including two ends and including a bottom portion, a cover secured to the upper portion of the body, at least one lamp secured to the bottom portion of the body, two lamp shades for securing to the side portions of the body, the lamp shades each including an upper portion and a lower portion, means for securing the lamp shades to the side portions of the body, two caps secured to the ends of the body and each including a lower portion, and a plate secured to the lower portions of the lamp shades and the caps.

The side portions of the body each includes a first upper engaging member and a first lower engaging member, the lamp shades each includes a second upper engaging member and a second lower engaging member for engaging with the first upper engaging member and the first lower engaging member of the body and for allowing the lamp shades to be easily secured to the side portions of the body.

The body includes a pair of first hooks provided on the upper portion, the cover includes two second hooks dependent downward for engaging with the first hooks and for securing to the body.

In accordance with another aspect of the invention, there is provided a lamp combination comprising a body including two side portions and including an upper portion and including two ends and including a bottom portion, a cover secured to the upper portion of the body, at least one lamp secured to the bottom portion of the body, two lamp shades secured to the side portions of the body, the lamp shades each including a lower portion, two caps secured to the ends of the body and each including a lower portion, a plate secured to the lower portions of the lamp shades and the caps, and a pair of supports each including a first securing member for securing to the lower portion of the cap and each including a pair of legs for supporting the lamp combination.

A pair of auxiliary assembling devices each includes a second securing member for securing to the lower portion of the cap and each includes an extension for engaging with the first securing member of the support and for allowing the supports to be adjusted closer to each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
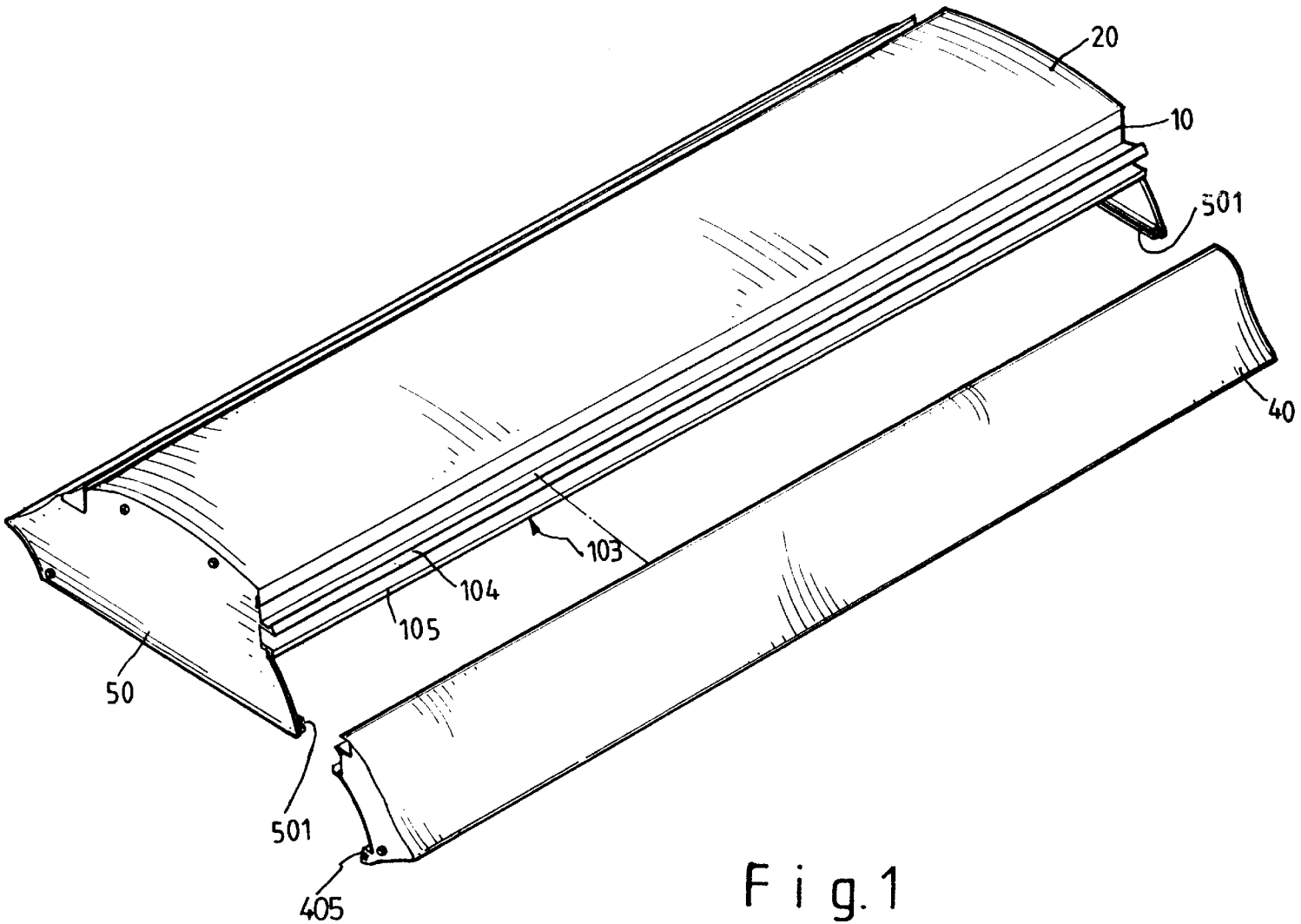
FIG. 1 is a partial exploded view of a lamp combination in accordance with the present invention.
Figure 2:
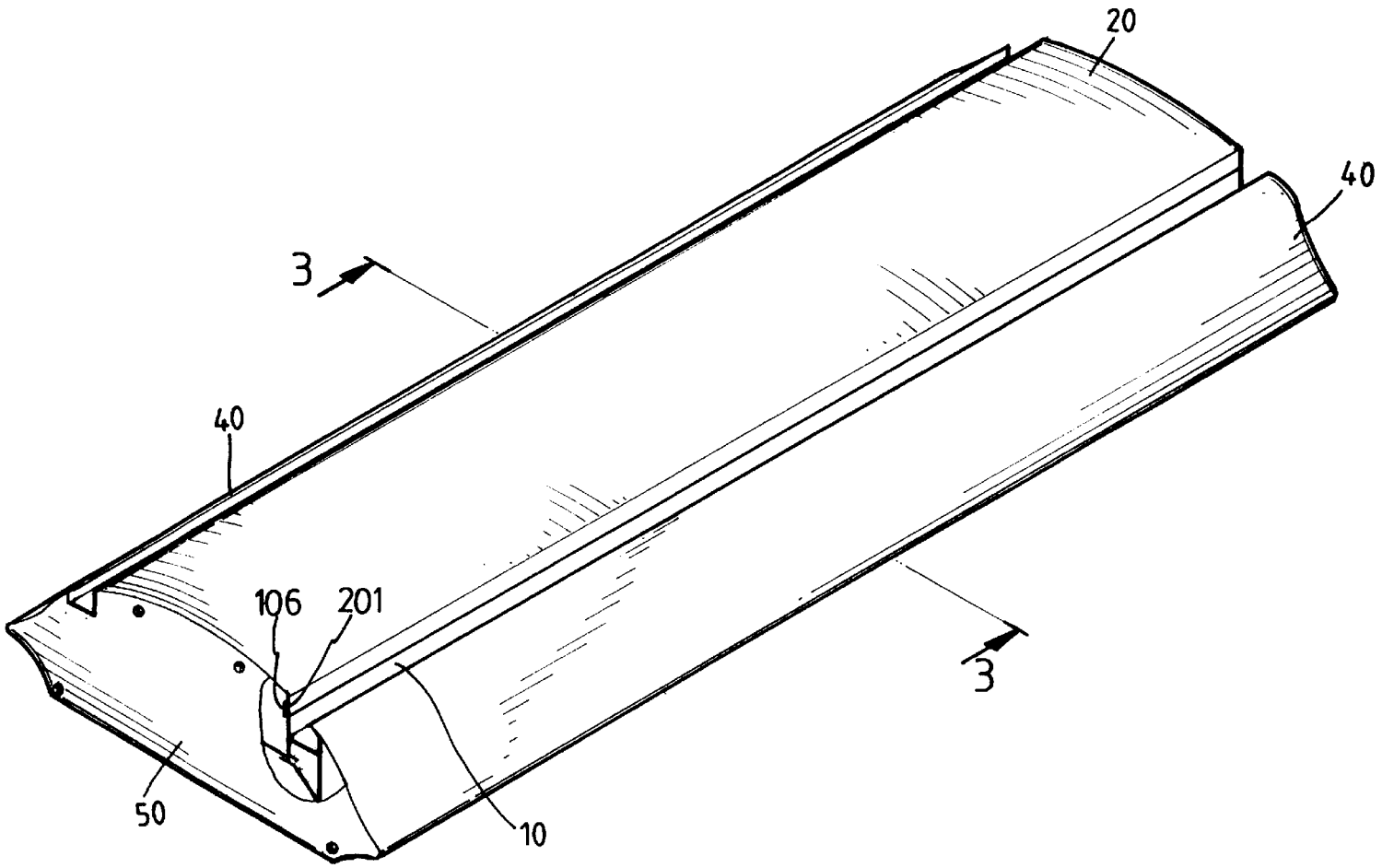
FIG. 2 is a perspective view of the lamp combination in which a portion of the lamp combination is cut off for showing the interior of the lamp combination.
Figure 3:
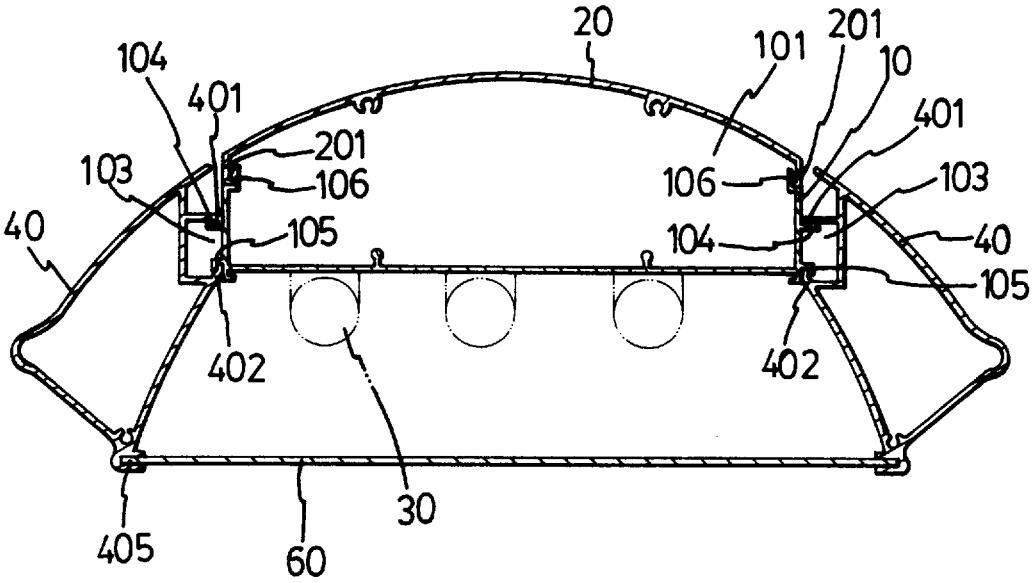
FIG. 3 is a cross sectional view taken along lines 3—3 of FIG. 2.

Referring to the drawings, and initially to FIGS. 1 to 3, a lamp combination in accordance with the present invention comprises a body 10 including a U-shaped cross section having a chamber 101 provided in top for receiving such as adaptor. One or more lamps 30 are secured to the bottom of the body 10. The body 10 includes two side portions each having an attaching device 103 and each having a hook 106 provided on top. The attaching devices 103 each includes an upper engaging member 104 and a lower engaging member 105. A cover 20 includes a pair of hooks 201 dependent downward for engaging with the hooks 106 and for securing to the body 10 and for enclosing the chamber 101. Two lamp shades 40 each includes an upper portion for securing to the attaching device 103 of the body 10 and each includes an upper engaging member 401 and a lower engaging member 402 for engaging with the engaging members 104, 105 of the attaching device 103 and for securing to the body 10. Two caps 50 are secured to the end portions of the body 10. The caps 50 and the lamp shades 40 each includes a groove 501, 405 formed in the bottom for engaging with and for supporting a plate 60 which is preferably transparent.

It is to be noted that the lamp shades 40 may be formed with various kinds of shapes or outer appearance for decoration purposes. For example, the lamp shade as shown in FIGS. 1–3 has a cross sectional shape similar to that of a UFO. In addition, the lamp shades 40 may be easily attached and secured to the body 10 by the engaging members 104, 105, 401, 402. The lamp shade is particularly designed for being secured to the aquarium.

Figure 4:
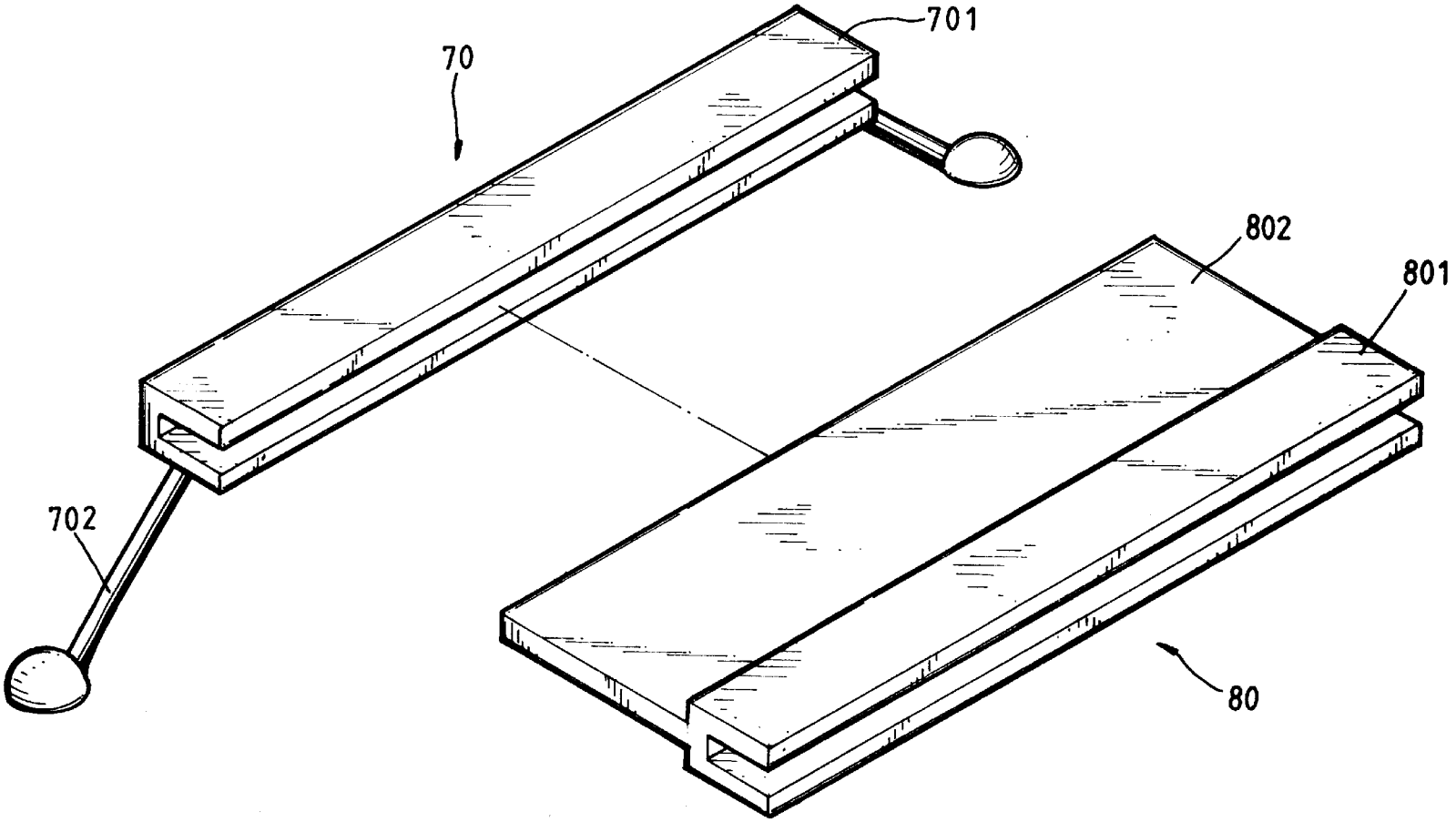
FIG. 4 is a partial exploded view showing a leg member for the lamp combination.
Figure 5:
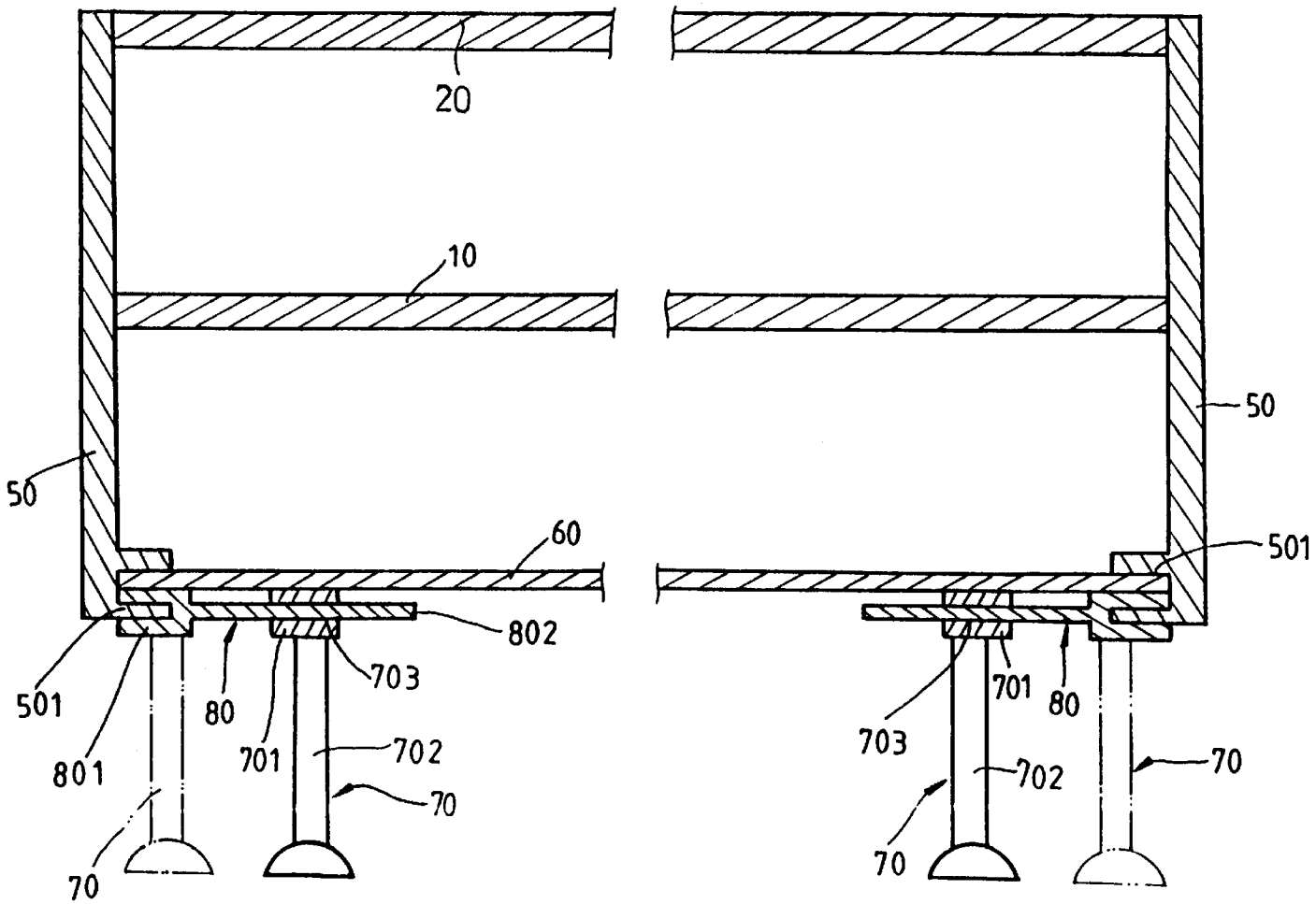
FIG. 5 is a cross sectional view of the lamp combination having the leg member secured to the bottom.

Referring next to FIGS. 4 and 5, a pair of supports 70 each includes a securing member 701 provided on top for engaging with the grooves 501 of the caps 50, best shown in dotted lines in FIG. 5, and each includes a pair of legs 702 for supporting the lamp combination at a suitable height. The height of the legs 702 may be selected to a suitable height for supporting the lamp combination above the water received in the aquarium.

A pair of auxiliary assembling devices 80 are further provided and each includes a securing member 801 for engaging with the grooves 501 of the caps 50 and each includes an extension 802 for engaging with the securing member 701 of the support 70. The legs 702 may thus be adjusted closer to each other, best shown in solid lines in FIG. 5. Accordingly, when the lamp combination has a size greater than that of an aquarium and may not be disposed in the aquarium, the legs 702 may be adjusted closer to each other by the auxiliary assembling devices 80 for supporting the lamp combination above the aquarium.

Accordingly, the lamp combination in accordance with the present invention includes a lamp shade having a number of elements that may be easily assembled. In addition, the lamp combination includes a pair of supports for supporting the lamp combination at a suitable height.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp combination comprising:

a body including two side portions and including an upper portion and including two ends and including a bottom portion;

a cover secured to said upper portion of said body;

at least one lamp secured to said bottom portion of said body;

two lamp shades for securing to said side portions of said body, said lamp shades each including an upper portion and a lower portion;

means for securing said lamp shades to said side portions of said body;

two caps secured to said ends of said body and each including a lower portion; and a plate secured to said lower portions of said lamp shades and said caps;

said side portions of said body each including a first upper engaging member and a first lower engaging member, said lamp shades each including a second upper engaging member and a second lower engaging member for engaging with said first upper engaging member and said first lower engaging member of said body and for allowing said lamp shades to be easily secured to said side portions of said body.

2. A lamp combination comprising:

a body including two side portions and including an upper portion and including two ends and including a bottom portion;

a cover secured to said upper portion of said body;

at least one lamp secured to said bottom portion of said body;

two lamp shades for securing to said side portions of said body, said lamp shades each including an upper portion and a lower portion;

means for securing said lamp shades to said side portions of said body;

two caps secured to said ends of said body and each including a lower portion; and a plate secured to said lower portions of said lamp shades and said caps;

said body including a pair of first hooks provided on said upper portion, said cover including two second hooks dependent downward for engaging with said first hooks and for securing to said body.

3. A lamp combination comprising:

a body including two side portions and including an upper portion and including two ends and including a bottom portion;

a cover secured to said upper portion of said body;

at least one lamp secured to said bottom portion of said body;

two lamp shades for securing to said side portions of said body, said lamp shades each including a lower portion;

two caps secured to said ends of said body and each including a lower portion;

a plate secured to said lower portions of said lamp shades and said caps;

a pair of supports each including a first securing member for securing to said lower portion of said cap and each including a pair of legs for supporting said lamp combination; and a pair of auxiliary assembling devices each including a second securing member for securing to said lower portion of said cap and each including an extension for engaging with said first securing member of said support and for allowing said supports to be adjusted closer to each other.

* * * * *